United States Patent [19]

Kakigi

[11] 4,198,627

[45] Apr. 15, 1980

[54] PHOTOELECTRIC SYNCHRONOUS SMOKE SENSOR

[75] Inventor: Takao Kakigi, Kanagawa, Japan

[73] Assignee: Cybernet Electronics Corporation, Kanagawa, Japan

[21] Appl. No.: 920,636

[22] Filed: Jun. 29, 1978

[30] Foreign Application Priority Data

Jul. 12, 1977 [JP] Japan ..... 52-92462[U]
Jul. 18, 1977 [JP] Japan ..... 52-95560[U]

[51] Int. Cl.[2] ..... G08B 17/10

[52] U.S. Cl. ..... 340/630; 250/574; 340/636

[58] Field of Search ..... 340/628, 630, 636; 250/564, 574

[56] References Cited

U.S. PATENT DOCUMENTS

| | | | |
|---|---|---|---|
| 3,316,410 | 4/1967 | Meili et al. | 340/630 X |
| 3,543,260 | 11/1970 | Engh | 340/515 X |
| 3,887,815 | 6/1975 | Kawakami | 340/630 |
| 3,917,956 | 11/1975 | Malinowski | 250/564 |
| 3,924,252 | 12/1975 | Duston | 340/630 |
| 3,946,241 | 3/1976 | Malinowski | 250/574 |
| 4,063,227 | 12/1977 | Peterson | 340/630 |
| 4,065,759 | 12/1977 | Handing | 340/630 |
| 4,087,799 | 5/1978 | Brouwer | 340/630 |
| 4,125,779 | 11/1978 | Malinowski | 340/630 |

*Primary Examiner*—John W. Caldwell, Sr.
*Assistant Examiner*—Daniel Myer
*Attorney, Agent, or Firm*—Oblon, Fisher, Spivak, McClelland & Maier

[57] ABSTRACT

In a photoelectric synchronous smoke sensor of the type wherein an electric power consumption is reduced by sample-detecting the smoke while bringing both light-emitting section and light-receiving section in the actuated state in synchronism with each other, a photoelectric synchronous smoke sensor characterized in that said light-emitting section is actuated by a pulse of a narrow pulse width and said light-receiving section by a pulse of a wide pulse width, and an input signal is applied to a synchronism detector only within the time width of said pulse of a narrow pulse width in order to increase sensitivity, to stabilize performance and at the same time, to automatically supervise a power source voltage.

2 Claims, 4 Drawing Figures

PHOTOELECTRIC SYNCHRONOUS SMOKE SENSOR

THE PRIOR ART DESCRIPTION

This invention relates to a smoke sensor and more specifically to a photoelectric synchronous smoke sensor.

In smoke sensors in general, a luminous flux-emitting source such as a light-emitting diode is placed in a black box which shields the light therearound and permits the introduction of only smoke. A light-receiving element is also incorporated in the dark box in such a manner as not to receive directly the light from the luminous flux-emitting source so that when smoke comes into the dark box and generates scattered light, the light-receiving element detects the scattered light and generates a fire alarm signal. If the smoke sensors are constantly kept in the operative detection state, however, power consumption becomes great and the chances for erroneous operation are increased. Accordingly, sample detection is customarily carried out by causing periodically the light-emitting diode to emit the light. In performing the sample detection in this manner, an accompanying circuit is required for actuating the light-emitting diode and the light-receiving element in synchronism with each other, whereby it becomes unavoidable that this accompanying circuit generates an electric noise. The electric noise thus generated in turn generates a signal similar to one which is generated when the smoke actually enters the dark box and consequently, a probability is extremely high for the erroneous signal to occur in the detection circuit wired electrically to the light-receiving element. In order to solve the problem, it is inevitable to enhance the detection level or to lower the sensitivity of the sensor, and power consumption must be lowered at the sacrifice of the sensitivity.

Another problem with the conventional smoke sensors is that since they use a battery as the power source, it is rather difficult to secure an adequate power source voltage for properly actuating the entire circuit over an extended period of use. If the power source voltage drops below a predetermined value, for example, it becomes impossible to achieve the smoke-sensing in an ordinary manner. In such a case, serious damages would be incurred all the more because the smoke sensor is inoperable.

SUMMARY OF THE INVENTION

It is an object of the present invention to obtain a photoelectric synchronous smoke sensor capable of sensing the smoke at a high level of sensitivity without causing erroneous operation irrespective of its low power consumption.

It is another object of the present invention to obtain a photoelectric synchronous smoke sensor capable of reliably supervising the limit of use by automatically detecting the state where the power source voltage drops below a proper level.

THE DRAWINGS

DESCRIPTION OF THE PREFERRED EMBODIMENT

An embodiment of the present invention will now be made apparent with reference to the accompanying drawings. A pulse generator PG consists of an oscillator OSC and a waveform shaping circuit WS. The oscillator OSC generates intermittently pulses of a predetermined duty cycle and is electrically wired to the waveform shaping circuit WS which generates a pulse a of a wide pulse width and a pulse b of a narrow pulse width. The waveform shaping circuit WS is in turn wired to a switch section SW as a route for the transfer of the wide pulse a and to a light emission stabilizer CS, a power source voltage limit detector VLD and a synchronism detector DET as a route for the transfer of the narrow pulse b. The light emission stabilizer CS and the power source voltage limit detector VLD are wired with each other while the light-emission stabilizer CS is wired to a pulse light-emitter PLE.

Figure 1:
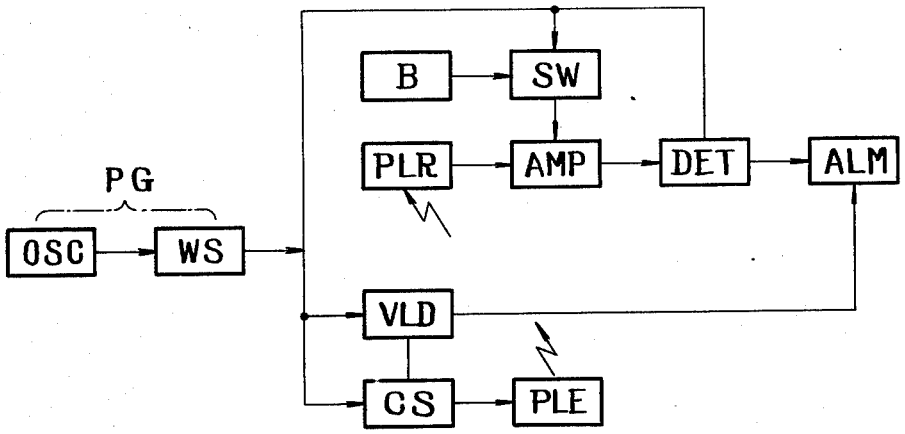
FIG. 1 is a block diagram of an embodiment of the present invention.

There is then disposed a pulse light-receiver PLR which is wired to an amplifier AMP. This amplifier is wired to the above-mentioned switch SW and synchronism detector DET, respectively. The detector DET and the above-mentioned power source voltage limit detector VLD are wired to an alarm ALM, respectively. Incidentally, a power source B is shown wired only to the switch SW (in FIG. 1), the connection to each circuit is more fully illustrated in FIG. 2.

Figure 3:
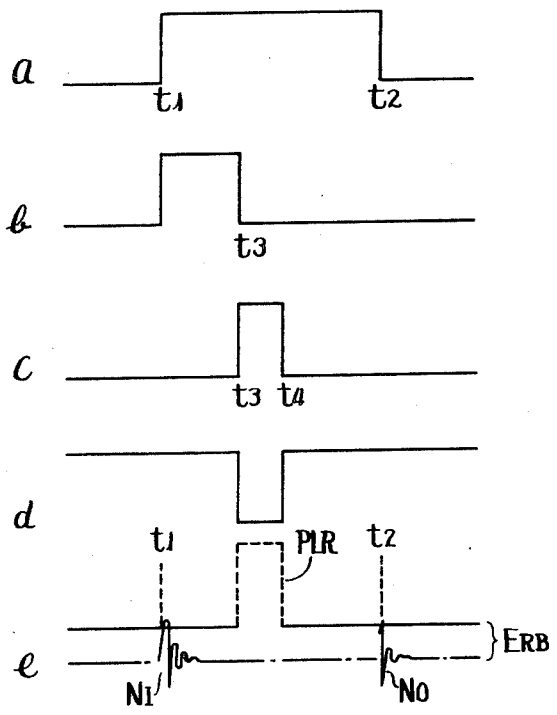
FIG. 3 is a time chart.

The oscillator OSC comprises PUT, switching elements $Q_1$, $Q_2$ and other circuit elements and generated intermittently the pulses in a predetermined duty cycle as mentioned previously. The narrow pulse b is generated from the switching element $Q_1$ while the wide pulse a is generated from the switching element $Q_2$ and they are shaped into the rectangular waveform shown in FIG. 3 by the waveform shaping circuit WS. First, the wide pulse a turns on a switching element $Q_4$ of the switch SW and drives the amplifier AMP which amplifies the input from the light-receiving element DR. Hence, the waiting time of the light-receiving element DR for the light-reception is in conformity with the time width $t_1-t_2$ of the wide pulse a. At the output terminal e of the amplifier AMP, therefore, there are produced all signals in the time width $t_1-t_2$ that are always in the biased state by a voltage $E_{RB}$ as shown in FIG. 3*e*.

At the point c of the waveform shaping circuit WS, on the other hand, a pulse c of a time width $t_3-t_4$ from the end $t_3$ of the narrow pulse b is generated and supplies a current to the light-emitting diode $D_L$ of the pulse light-emission section PLE through switching elements $Q_{13}$, $Q_{14}$ of the light-emission stabilizer CS and causes the diode to emit the light with the time width $t_3-t_4$.

At the point d of the waveform shaping circuit WS, there is produced a pulse d which is obtained by reversing the abovementioned pulse c. This pulse d turns on a switching element $Q_6$ of the synchronism detector DET. Accordingly, the output of the amplifier AMP is generated in the time width $t_1-t_2$ and the time width for a charging current to flow to a capacitor $C_5$ is limited to $t_3-t_4$, no matter when the switching element $Q_5$ or $Q_7$ may be turned on. Accordingly, in the time width $t_1-t_2$ in which both light-receiving element $D_R$ and amplifier AMP are in the operative condition, noises $N_I$, $N_o$ tend to occur due to the time constant of the circuit at the start and end of the pulse a. However, since these noises $N_I$, $N_o$ are out of the time width $t_3-t_4$, the synchronism detector DET is never actuated.

Then the smoke comes into the box and the light-receiving element $D_R$ receives the light in the time width $t_3-t_4$ in which the light-emitting diode $D_L$ emits the light, the switching elements $Q_6$, $Q_7$ are turned on and the capacitor $C_5$ is charged. After the passage of the time width $t_3-t_4$, the switching elements $Q_6$, $Q_7$ are turned off, but the switching element $Q_8$ is kept on till the charge stored in the capacitor $C_5$ is discharged through the resistor $R_9$ whereby the switching element $Q_{10}$ of the alarm ALM is turned on through an invertor $INV_5$ and actuates a buzzer $R_Y$. When the fire actually occurs, the same operation is repeated in the subsequent cycle of the oscillator OSC so long as the smoke is present even if the potential of the capacitor $C_5$ starts lowering. As the capacitor $C_5$ is again charged, the action of the alarm ALM continues.

Though the power consumption is lowered by performing the sampling detection in this manner, the detection timing is restricted within the time width $t_3-t_4$ and consequently, it is possible to generate a signal free from errors without the influence of the noises $N_I$, $N_o$. In addition, the sensitivity can also be enhanced by lowering the bias voltage $E_{RB}$.

Figure 2:
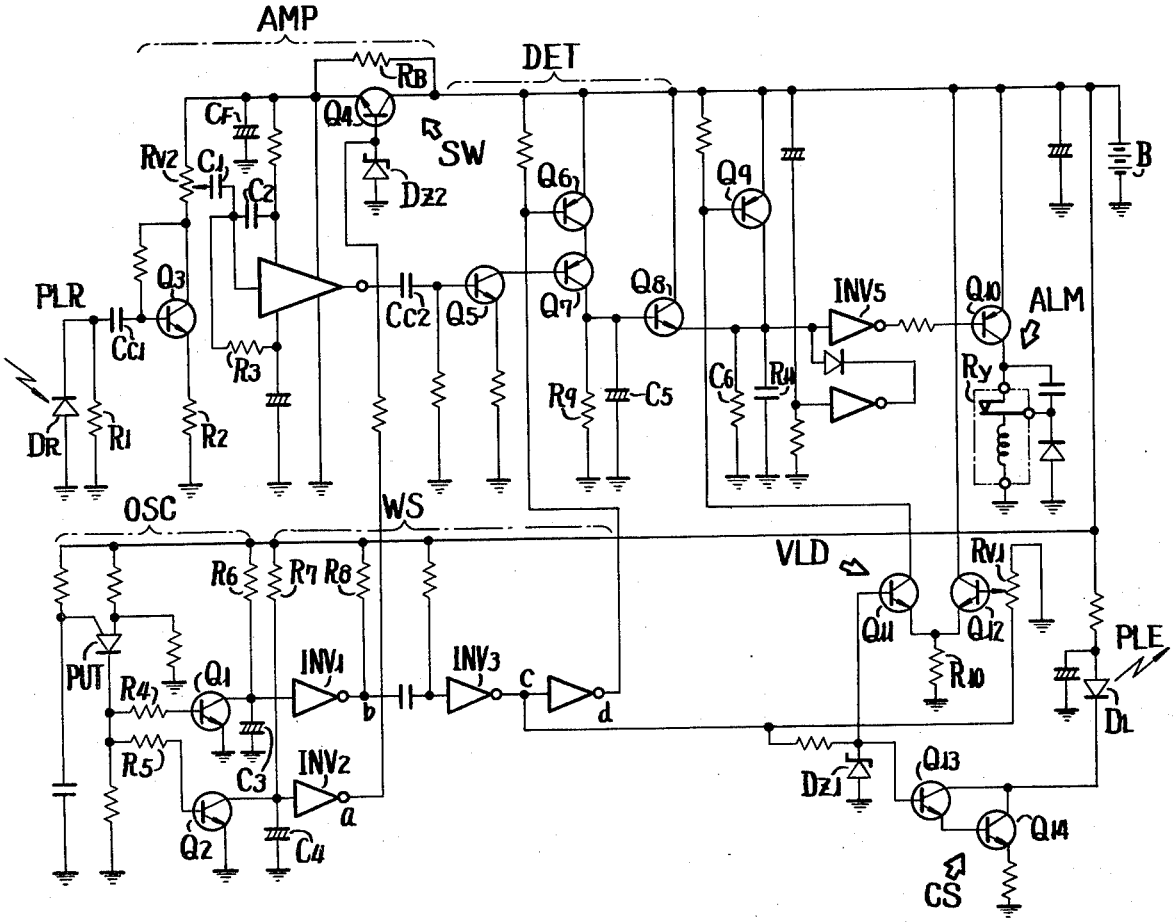
FIG. 2 is a circuit diagram of the embodiment of the invention.
Figure 4:
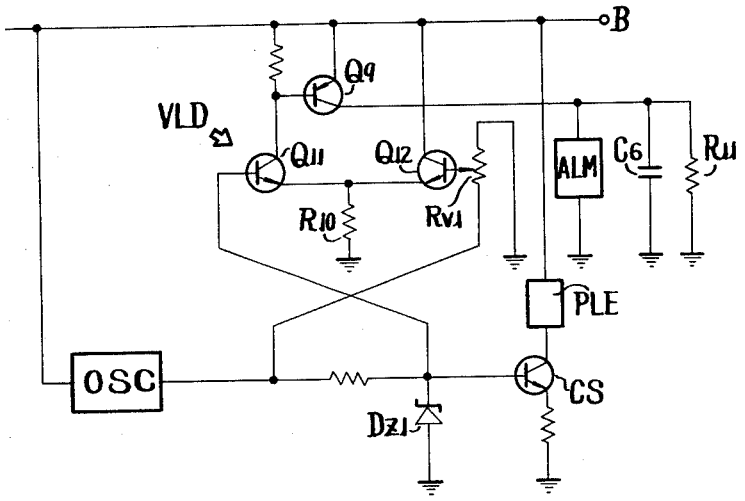
FIG. 4 is a circuit diagram of only the portion of a lower limit voltage alarm circuit.

Next, the explanation will be given on the power source voltage limit detector VLD with reference to FIG. 4 which is a partially detailed view of FIG. 2. First, pulses of a predetermined duty cycle are generated from the oscillator OSC. These pulses have the time width $t_3-t_4$ as mentioned already and cause the pulse light-emitter PLE to emit the light within this time width. When these pulses are not generated, both switching elements $Q_{11}$ and $Q_{12}$ are turned off. If the pulses are generated under the condition where the voltage of the power source B is normal, its voltage is higher than a zenor voltage of a reference voltage $DZ_1$ and turns on the switching element $Q_{12}$ whereby a voltage produced on the resistor $R_{10}$ applies a reverse bias to the switching element $Q_{11}$ and causes it to maintain the OFF state.

However, if the voltage of the power source B drops below a predetermined value, the switching element $Q_{12}$ is not turned on at the time of occurrence of the pulses and the reverse bias is not applied to the switching element $Q_{11}$. In consequence, the switching element $Q_{11}$ is turned on and at the same time, the switching element $Q_9$ also is turned on, whereby the capacitor $C_6$ is charged and the alarm ALM is actuated to raise an alarm sound till the charge is discharged through the resistor $R_{11}$. In this manner it is possible to automatically supervise the power source B using the same alarm ALM.

What is claimed is:

1. A photoelectric synchronous smoke sensor comprising: a pulse generator generating pulses of a wide pulse width and pulses of a narrow pulse width in a predetermined duty cycle; a light-receiving pulse receiver and an amplifier, each brought into the operative state by said pulses of a wide pulse width; a pulse light-emitter and a power source voltage limit detector, each brought into the operative state by said pulses of a narrow pulse width; a synchronism detector receiving a signal from said amplifier as its input in a time width corresponding to that of said pulses of a narrow pulse width; and an alarm actuated by a signal from said synchronism detector.

2. The photoelectric synchronous smoke sensor as defined in claim 1 wherein said alarm actuated by the signal from said light-receiving pulse receiver is used conjointly for said power source voltage limit detector and is actuated by a power source voltage drop.

* * * * *